US007018131B2

(12) United States Patent
Jordan

(10) Patent No.: US 7,018,131 B2
(45) Date of Patent: Mar. 28, 2006

(54) LONG LIFE INTELLIGENT ILLUMINATED ROAD MARKER

(76) Inventor: Wesley B. Jordan, 29024 Laguna Trail, Pine Valley, CA (US) 91962

( * ) Notice: Subject to any disclaimer, the term of this patent is extended or adjusted under 35 U.S.C. 154(b) by 0 days.

(21) Appl. No.: 10/835,362

(22) Filed: Apr. 28, 2004

(65) Prior Publication Data

US 2005/0244225 A1 Nov. 3, 2005

(51) Int. Cl.
*E01F 9/06* (2006.01)

(52) U.S. Cl. ..... 404/16; 404/12; 404/14; 404/15

(58) Field of Classification Search ..... 404/11–16
See application file for complete search history.

(56) References Cited

U.S. PATENT DOCUMENTS

| | | | | |
|---|---|---|---|---|
| 4,050,834 | A | 9/1977 | Lee | |
| 4,136,990 | A * | 1/1979 | Morgan | 404/9 |
| 4,151,829 | A * | 5/1979 | Wilson | 126/683 |
| 4,227,772 | A * | 10/1980 | Heenan | 359/531 |
| 4,314,198 | A | 2/1982 | Rogers | |
| 4,668,120 | A * | 5/1987 | Roberts | 404/12 |
| 5,412,381 | A * | 5/1995 | Dicks | 340/908.1 |
| 5,703,719 | A | 12/1997 | Chen | |
| 5,782,552 | A | 7/1998 | Green et al. | |
| 5,839,816 | A * | 11/1998 | Varga et al. | 362/153.1 |
| 5,984,570 | A | 11/1999 | Parashar | |
| 6,514,595 | B1 * | 2/2003 | Sprouts | 428/143 |
| 6,554,463 | B1 * | 4/2003 | Hooker et al. | 362/555 |
| 2003/0100837 | A1 * | 5/2003 | Lys et al. | 600/476 |

FOREIGN PATENT DOCUMENTS

| | | | |
|---|---|---|---|
| WO | WO 92/07405 | * | 4/1992 |
| WO | WO 01/42567 | | 6/2001 |
| WO | WO 01/58219 | | 8/2001 |

* cited by examiner

*Primary Examiner*—Raymond W Addie
(74) *Attorney, Agent, or Firm*—Ames IP Law

(57) ABSTRACT

Self-contained solar-powered long-life intelligent illuminated road markers are provided comprising a one-piece housing formed of optionally colored plastic capable of transmitting light. Light is reflected by reflective coating or generated internally by LED which is powered by a long life battery, the charging of which is controlled by electrical circuitry which comprises a peripheral interface controller. The electrical circuitry provides intelligent control for a variety of modes corresponding to diverse driving conditions, and can enter a low-power sleep mode to conserve battery life.

20 Claims, 3 Drawing Sheets

LONG LIFE INTELLIGENT ILLUMINATED ROAD MARKER

CROSS-REFERENCE TO RELATED PATENT APPLICATIONS

NOT APPLICABLE.

BACKGROUND OF THE INVENTION

The present invention concerns solar powered road markers.

The following information is provided solely to assist the understanding of the reader. None of the information provided or references cited is admitted to be prior art to the present invention.

In most applications, the current road markers are small, rectangular housings that include a reflective material arranged such that light from the headlights from an approaching motor vehicle will be reflected back to the driver, thereby enhancing visibility of the marker. In many cases, the housing is mounted on the road surface or in a small depression in the road surface, typically using an adhesive. However, such reflective road markers do not function well under some adverse conditions, such as inclement weather, e.g., foggy conditions, or where an appreciable coating is present on the surface of the marker, as such conditions substantially reduce the amount of light that is effectively reflected from the marker back to the vehicle driver.

One way of addressing such difficulties is to use a marker with an internal light source rather than relying solely on reflected light. While markers utilizing wires to supply power for the light source can be constructed, such markers are expensive to install and maintain. An alternative is to use a self-contained marker that has an internal power supply. Such internal power supply can be designed to utilize one or more photovoltaic devices (also referred to as solar cells) and an energy storage device such as a rechargeable battery.

A number of different solar powered road markers have been described. For example, Lee, U.S. Pat. No. 4,050,834 describes an internally powered traffic control device that includes a support member, a solid state light emitting device such as a light emitting diode (LED), a power supply such as a rechargeable battery pack, a solar cell, and a network for controlling the energization of the LED.

Roberts, U.S. Pat. No. 4,668,120 describes a solar powered illuminated reflector that includes a housing, at least one reflector element, a light source, a window member or lens for transmitting light outward from the light source in a predetermined direction, and a photovoltaic power system.

Parashar, U.S. Pat. No. 5,984,570 describes a self energized automatic surface marker that includes a housing, one or more LEDs, and a solar powered energy storage system that includes solar cells and 5–10 storage capacitors.

Green et al., U.S. Pat. No. 5,782,552 describes a light assembly that includes a LED, a capacitor to energize the LED, and a solar cell to charge the capacitor. The patent indicates that in a particularly desirable aspect, the light assembly is housed in a plexiglass shell and potted with appropriate potting compounds.

Chen, U.S. Pat. No. 5,703,719 describes a reflector road sign with self-provided light means. The reflector road sign includes a reflector body made of tempered glass, a casing made to receive the reflector body, a solar lighting system that includes a LED, a rechargeable battery, a control circuit, and a reflecting device mounted around the LED lamp.

WO 01/42567 (PCT application PCT/KR00/01425) describes a road stud using a solar cell. The road stud has a portion that is embedded in the road, and an upper light emitting portion.

WO 01/58219 (PCT application PCT/IL01/00083) describes a method for reducing energy consumption of LED illuminated road markers, and road markers that utilize that method. The energy consumption is said to be reduced by supplying current pulses to an LED, where each pulse is characterized by having a pick value higher from the nominal working current value of the LED, and the duty-cycle of the of the pulses is correspondingly short, such that the LED is provided with an effective current within its permitted current range.

Rogers, U.S. Pat. No. 4,314,198 describes a solar power source for a light system.

Each of the references cited above is incorporated herein by reference in its entirety, including drawings.

SUMMARY OF THE INVENTION

The present invention provides advantageous solar powered road markers constructed such that the markers have a long life without requiring any maintenance. In addition, certain embodiments are designed such that the marker can be "on" continuously, rather than having to be shut down during high illumination periods. The markers are generally designed using a single piece housing, constructed of a material that is resistant to abrasion, as well as to discoloration and other degradation due to UV light exposure, and utilizes a battery system that tolerates trickle charging while still providing a long operating life. As a result, by limiting deterioration of the housing and the battery, typically the present markers have an operating life of at least 5 years.

In a first aspect, the invention provides an illuminated road marker. The marker includes a one-piece housing formed of a formable material, e.g., a plastic, generally a non-yellowing plastic, preferably an abrasion material. The housing has a top plate and perimeter sides, where at least one perimeter side has a light transmission surface through which light can be transmitted, and where the top plate and the sides define a cavity in the housing. The marker also includes at least one, typically 3–6, light emitting diodes (LED) positioned within the cavity such that light produced by the LED is transmitted through the light transmitting surface, a long life battery within the cavity that energizes the LED; at least one solar cell within the cavity adjacent to the top plate, where the solar cell recharges the battery; electrical circuitry within the cavity configured to control charging of the battery. In certain embodiments, the electrical circuitry can also control and modify operation of the LEDs (e.g., rate of LED flashing, duration of each LED flash); and encapsulating material filling the cavity. The road marker has an operating lifetime without maintenance of at least 3 years, typically at least 5 years. It was found that such a long operating lifetime could be achieved by incorporating a battery that tolerates trickle charging (e.g., at about 0.01 to 0.05 It) and designing the circuitry such that the power usage is sufficiently low to avoid excessive battery drain. Even more advantageously, the battery tolerates both trickle charging and high level charging, e.g., at about 0.1 to 0.4 It.

In the context of charging rates, $It(A)=C(A)=Cn(Ah)/1h$. Thus, It (also referred to as C) is the charge current in amperes, and Cn is the battery capacity in amp-hours.

In certain embodiments, a road marker draws less than 1.0 mA; less than 1.5 mA; less than 2.0 mA; from 0.5–5.0 mA; from 0.5–10 mA; from 1.0–10 mA from the battery during flashing. In certain embodiments, during flashing, a road marker draws less than 0.8; less than 1.0; less than 1.3; less than 2.0; less than 2.5; less than 3.0; less than 4.0; less than 5.0; less than 7.0; less than 10.0 mW (milliwatt); 0.8–2.0; 0.8–5.0; 0.8–10.0 mW from the battery. In particular embodiments, the duration and/or frequency of flashing can be varied; where one or both of duration and frequency can be varied, the specified current or power draw during flashing is for the minimum combination of flash duration and frequency; the specified current or power draw during flashing is for the middle flash duration value and middle flash frequency value; the specified current or power draw during flashing is for the maximum flash duration value and maximum flash frequency.

In certain embodiments, a road marker includes a "sleep mode", in which the LEDs are not flashed. The marker can be in sleep mode, for example, when it receives no light for a particular period (e.g., for at least 12, 18, or 24 hours, for example, in its packaging following manufacture) and/or can go into sleep mode when the battery charge state is very low and there is insufficient light for charging. In sleep mode the marker draws very little current from the battery, e.g., no more than 10, 20, 30, 40, or 50 microamps. When the unit then receives light, it transitions to flashing mode, increasing the current (or power) draw, e.g., to about 1, 2, 3, or 4 mA, or other level as specified herein. In particular embodiments, the marker responds to changed light conditions by exiting sleep mode within 1, 2, 4, 6, 8, 10, 15, or 20 minutes. This response period can be determined by the control program. Generally, a marker in sleep mode checks the light condition and/or battery charge state at intervals equal to the response period. In particular embodiments, the marker can remain in sleep mode for at least 6 mos., 12 mos., 18 mos., or 24 mos. before the charge in a fully charged battery in the marker is depleted such that the marker cannot illuminate the LEDs.

In particular embodiments, the charge control circuitry employs diode and mosfet components in the manner illustrated in the exemplary design of FIG. 4.

As used herein in connection with materials for constructing the present marker housings, the term "formable" indicates that the material in question can be shaped into a desired final form for a road marker housing, e.g., using methods such as casting, molding, and machining.

In this context, the term "plastic" refers to a material that is a synthetic or semisynthetic material that can be molded or extruded into objects or films or filaments or used for making e.g. coatings and adhesives. Typically the material is one of many high-polymeric substances, including both natural and synthetic products, but excluding the rubbers, that at some stage in its manufacture, is capable of flowing, under heat and pressure if necessary, into the desired final shape.

While the present description refers to light emitting diodes (LEDs), the invention also contemplates the use of other types of light generating devices which do not have more than 30% (preferably not more than 20%, or 10%, or 5%) greater energy consumption than current LEDs for equivalent light output, and which are compatible with the size limitations for usage in road markers. Thus, the term "LED" as used herein includes such additional light generating devices unless clearly indicated to the contrary, e.g., by using the form, LED*.

In particular embodiments, the operating lifetime of the road marker is at least 4, 5, 6, 7, 8, 9, 10, or more years.

As used in connection with batteries for use in the present markers, the term "long life" means an operating lifetime of at least 3 years, preferably at least 4, 5, 6, 7, 8, 9, 10, or more years under conditions of daily charging and temperatures of 0–38° C., preferably over a temperature range of −10 to 40° C., or −10 to 50° C., or −20 to 40° C., −20 to 50° C.

In the present context, for a set of road markers of a particular design and construction the term "operating lifetime" refers to the median in-service time (for service beginning within one month of manufacture) from beginning of service until unit failure. In particular embodiments, the at least 70 percent of the units of a particular design and construction, preferably at least 80%, 90%, 95%, or 98%, achieve the specified operating lifetime. "Unit failure" refers to a marker unit ceasing to provide illumination in accordance with its design operating mode(s) with at least ½ of the rated output intensity from at least ½ of the LEDs in the unit.

In connection with batteries for use in the present road markers, the phrase "tolerates trickle charging without deterioration" means that the battery can be trickle charged at less than 0.05 lt (It is also referred to as C) for at least 1000 cycles at 20° C. without battery capacity dropping below 80% of rated capacity.

In certain embodiments, the battery is charged using intermittent charging. The intermittent charging can be at low rates, e.g., 0.03–0.05 It, 0.04–0.06 It, 0.05–0.1 It, or at higher rates, e.g., 0.1–0.5 It, 0.1–0.3 It, 0.2–0.4 It.

In the context of battery charging, the term "intermittent charging" means that the charging is discontinuous, with charging initiated only when the battery voltage drops to or below a selected voltage, e.g., 1.0 or 0.9 V, and terminates when a selected voltage is reached, e.g, 1.3, 1.4, 1.5, or 1.6 V.

In particular embodiments, the road marker can be configured to operate in one operating mode, e.g., continuously, or in any of a plurality of different operating modes, e.g., any combination of continuously, illuminated during dark conditions and not illuminated during light conditions, and illuminated in response to adverse visibility conditions other than darkness. In certain embodiments, the marker operates continuously when the marker solar cells receives illumination in a day at least the equivalent of 300 mW-hr, 400 mW-hr (mW=milliwatt), 500 mW-hr, 600 mW-hr, 700 mW-hr, 800 mW-hr, 900 mW-hr, or 1000 mW-hr.

Indication that a road marker operates "continuously" means that the marker is illuminated without an interruption based on external environmental condition, or an interruption of longer than 5 seconds, except that a marker operating "continuously" can cease illuminating when the marker is unable to deliver sufficient electrical energy to the light emitting component(s) due to stored energy droping below the minimum for such illumination.

In certain embodiments, the housing is constructed of a polycarbonate; the polycarbonate has an abrasion resistant surface; the polycarbonate has an abransion resistant surface coating; the polycarbonate is General Electric LEXAN® XL10 or a material substantially equivalent.

Those skilled in the art of plastics design and fabrication are familiar with selecting and using various surface coatings, in particular including abrasion resistance coating. For example, such coatings are used for eyeglasses, headlights and headlight covers, aircraft applications, and the like. Exemplary abrasion resistant coatings that can be used in the present invention include, without limitation, silicone based coatings (e.g., GE SHC 1200, and GE PHC587), fluorinated expoxies, fluorinated urethanes, and fluorinated polyol coatings. Thus, in particular embodiments the present road markers have an abrasion resistant coating added to at least one, or preferably all of the side and top external surfaces.

The appropriate time and manner of applying the coating will depend on the characteristics of the coating material, but typically the coating will be applied after the housing is formed. For example, the coating can be applied after the coating is formed, but before the internal components are added, or after the marker is fully assembled.

As used herein, the term "abrasion resistant" is a relative term, having a meaning consistent with industry usage for the respective material, indicating that the material is more abrasion resistant than conventional materials of the same general chemical type.

In the context of housing materials, such as polycarbonates, the term "substantially equivalent" indicates that the physical properties of the material (e.g., strength, abrasion resistance, clarity, weatherability, formability, etc.) are sufficiently similar that one of ordinary skill in the art would recognize that the "substantially equivalent" material as being suitable to the same applications as the reference material.

In certain embodiments, the battery is a nickel metal hydride battery, such as a Panasonic H series battery or a battery substantially equivalent thereto.

In the context of battery selection for the present invention, the term "substantially equivalent" indicates that the operating characteristic (e.g., charge capacity, discharge characteristics, lifetime, temperature resistance, resistance to physical stress, etc.) of the "substantially equivalent" battery are sufficiently similar to the reference battery that one of ordinary skill in the art would recognize the batteries as being suitable for the present road marker applications.

In certain embodiments, the road marker is turned on using an internal switch, which can be triggered by an external signal such as a set of light pulses. Such external signal, e.g., light pulses, can also be used to turn off the marker, and/or to change operation mode.

In certain embodiments, the marker includes a light/dark sensor and/or a reflected light sensor, e.g., a fog sensor.

The term "fog sensor" refers to a detection device that detects scattered light from water droplets suspended in air. In connection with the present road markers, a "fog sensor" detects scattered light from the air above the marker. The marker can then trigger a desired action when the scattered light level reaches a particular level, for example, turn on flashing or increase flash duration.

In particular embodiments the marker includes a light reflective material disposed such that incident light from a motor vehicle approaching the marker from the light transmission side is reflected from that light transmission side, e.g., on the inside surface of one or more housing sides. The marker can also include light reflective material that is disposed to reflect light from the LED that is not initially transmitted through the light transmitting surface, e.g., light is emitted from the LED in a direction such that that light does not pass through the light transmitting surface without first contacting another surface or is reflected back from the inside of the housing body. The light reflective material for reflecting light emitted from the LED and the reflective material for reflecting light from an approaching motor vehicle may be the same or different material, and may be the same or different piece or pieces. One such reflective material is 3M™ product 3990 VIP Diamond Grade™ reflective sheeting.

In particular embodiments, the marker includes 1, 2, 3, or 4 separate solar cells. In particular embodiments, 1 solar cell is used to provide darkness and light detection. In particular embodiments where 3 cells are used, the solar cells each have a rated output of at least 50, 60, 70, 80, 100, 125, 150, 175, 200, 250, 300, 350, 400, 450, or 500 mA per cell at 0.5 V. In particular embodiments, the solar cells each are rated to produce at least 70, 80, 90, 100, 125, 150, 175, 200, 225, 250, 275, 300, or more mW of power. In particular embodiments, the solar cells in a marker are rated to produce at least 150, 200, 250, 300, 350, 400, 450, 500, 550, 600, 650, 700, 800, 900, or 1000 mW in total.

In certain embodiments, the light from an LED is colored; the light from an LED is red; the light from an LED is amber; the light from an LED is blue; the light from an LED is white; the housing is transparent. In certain embodiments, the marker includes LEDs of at least 2 different colors. In certain embodiments, the marker includes LEDs that operate on different voltages.

As used herein in connection with light color, the term "colored" indicates that the light is not white or warm white. Examples of such colors include red, blue, green, amber, and yellow.

In some embodiments, there are a plurality of LEDs that emit light through the light transmitting surface, for example, 2, 3, 4, 5, 6, 7, 8, 9, 10, or more LEDs. A plurality of LEDs that emit light through the same light transmitting surface are oriented in different directions, which can differ by 2–15 degrees, 4–15 degrees, 2–10 degrees, 4–10 degrees, 5–8 degrees.

In the context of the orientation of light emitting components such as LEDs, the term "different directions" means that there is a non-zero angle between the direction of illumination for two different light emitting components. Specifying that directions for the orientations of a plurality of different light emitting components is within a particular degree range, means that the angle between the orientation of a first component and the orientation of a second component having an orientation that is the closest among the plurality of light emitting components to the orientation of the first component is within the specified range.

In certain embodiments, the marker operates continuously; the marker operates in any of a plurality of different modes; a plurality of different operating modes includes any combination of two or more of continuously, illuminated during dark conditions and off during light conditions, and illuminated during adverse visibility conditions other than darkness only, such as fog or other condition with high reflected light.

In particular embodiments, the marker also includes a bonding material attached to or embedded in the bottom surface of the marker, e.g., attached to or encapsulated in the bottom surface of the encapsulating material filling the housing cavity.

The term "bonding material" is used to refer to a material that increases the bond strength for one of the present markers adhered to a mounting surface, such as a road surface. In most cases, the bonding material increases the surface area of the surface on which the bonding material is present, and can also provide shapes and/or compositions that increases bond strength.

In a related aspect, the invention provides an illuminated road marker that includes a one piece housing formed of a polycarbonate plastic, preferably a non-yellowing polycarbonate. The housing includes a top plate and perimeter sides, where at least one perimeter side includes a light transmission surface through which light can be transmitted, and where the top plate and the sides define a cavity in the housing; a plurality of light emitting diodes (LEDs) positioned within the cavity such that light produced by the LEDs is transmitted through the light transmitting surface, and where the LEDs point in at least two different directions different by 2 to 15 degrees; a long life battery within the cavity that energizes the LED, where the battery tolerates trickle charging without deterioration; a solar cell within the cavity adjacent to the top plate, where the solar cell recharges the battery; electrical circuitry within the cavity configured to control charging of the battery; and encapsulating material filling the cavity. The road marker operates continuously and has an operating lifetime without maintenance of at least 3 years, typically at least 5 years.

Particular embodiments include embodiments as specified for the preceding aspect.

Another related aspect concerns a method for marking a travel lane on a roadway, involving installing a plurality of long life road markers in one or more lines parallel to the travel lane, where the long life intelligent road markers are markers as described in the preceding aspect, or otherwise described herein as one of the present road markers.

The invention also concern a method for increasing adhesive bonding of a road marker to a road surface, by embedding a particulate bonding material in the bottom surface of the road marker, or by adhering such bonding material to the bottom surface.

In particular embodiments, the bottom surface is or includes the bottom surface of an encapsulating material filling a cavity in a housing; the bonding material is a particulate rock material, such as garnet; the road marker is a marker as described herein for the present invention.

The method also provides a method for increasing the visibility angle for an illuminated road marker that includes a plurality of narrow viewing angle light emitting components, such as LEDs. The method involves angling the plurality of LEDs in a plurality of directions differing by small angles, e.g., 2–15 degrees, 4–15 degrees, 2–10 degrees, 4–10 degrees, 5–8 degrees, or other degree or degree range specified for the present road markers. For example, each LED transmitting through one transmission surface can each point in a different direction.

In the context of the present markers, the term "visibility angle" means the included angle in a particular plane through which light emitted from the marker provides useful visibility as a road marker. In general, the marker will be deemed to provide useful visibility when the light intensity over the angle range is at least 0.2 times the maximum intensity for one of the light emitting elements used in the marker, at the same distance from the marker.

In connection with LEDs, the term "viewing angle" refers to the full angle at which brightness is half of the brightness from dead center. Thus, if $\phi$ (angle theta) is the angle from off center (0°) where the LED's brightness is half, then $2\phi$ is defined as the full viewing angle In the present context, the term "narrow viewing angle" refers to a viewing angle of 10 degrees or less.

In an additional aspect, the invention concerns a method for making an illuminated road marker. The method involves vacuum forming a marker housing from sheet material, inserting internal components, and sealing the bottom of the housing.

In particular embodiments, the vacuum forming is performed simultaneously for multiple housing units from a single sheet of the material, e.g., at least 10, 20, 40, 60, 80, or 100 units. In particular embodiments, the bottom is sealed using an encapsulating material, e.g., an epoxy resin, that at least partially fills the void space in the housing. In accordance with the description above, a binding material can be adhered to the bottom of the housing, e.g., embedded in the encapsulation material. In particular embodiments, the internal components are as described herein. In particular embodiments, the fully assembled road marker is placed in a light proof or light resistant packaging; e.g., in the case of a road marker that shuts down or goes into sleep mode after a particular period of time without light, the amount of light passing through the packaging is sufficiently low that the marker does shut down of go into sleep mode due to the light blocking of the packaging.

In particular embodiments, markers constructed according to any of the references cited in the Background herein is expressly excluded from any one or any combination of the various aspects of the present invention.

Additional embodiments will be apparent from the following Detailed Description and from the claims.

DETAILED DESCRIPTION OF THE PREFERRED EMBODIMENTS

Figure 1:
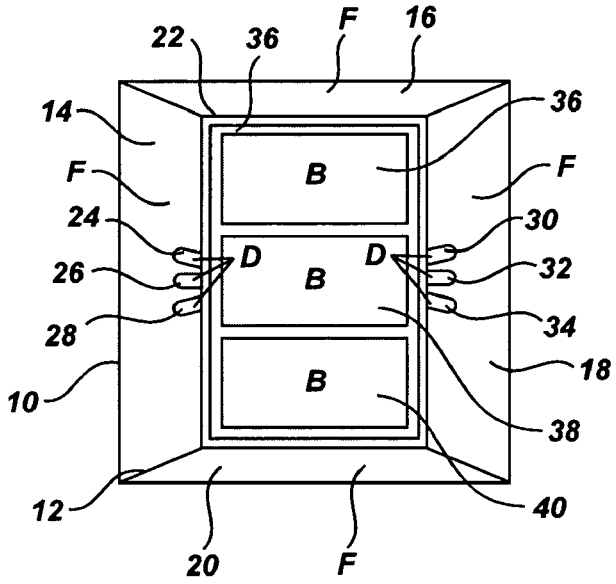
FIG. 1 is a top view of one embodiment of the present invention.

The present road markers are particularly adapted for highway and remote applications, as they are designed to have long operating life while being mechanically and electronically simple. Nonetheless, the markers can be used or configured for use in many other applications. Such long life is especially advantageous for highway applications as it significantly reduces the costs associated with maintenance and/or replacement. The long operating life is achieved through the use of a suitable housing material, along with suitable combinations of solar cells, batteries, and control circuitry and/or control programming.

Typically the road markers include a housing that has a cavity opening downward. The cavity contains the illumination components, including one or more low energy consumption light emitting elements (typically light emitting diodes (LED*s), energy storage components such as batteries (or, if desired, storage capacitors), one or more solar cells, and any needed circuitry and logic components, e.g., a processor. The cavity is filled with an encapsulation or potting material, which protects the internal components as well as the housing. The encapsulation material is typically a resin, e.g., an epoxy resin, and should provide both good strength and a degree of residual flexibility (e.g., in order to prevent cracking and/or separation of the material and/or damage to encapsulated components). The encapsulation material fills the cavity and supports the housing so that it is not broken during impact, e.g., impact from car and truck tires. The encapsulation material also generally seals the internal components against moisture. Further, the encapsulation material can provide a bonding surface for attaching the marker to a road surface.

In general, these markers are powered by at least one solar cell, and typically a set of such solar cells. These cells are used to recharge a long life expectancy battery, which should be able to be trickle charged without significant deterioration in capacity during its operational lifetime.

The markers can be configured in various ways. For example, markers can be designed for continuous operation, thereby allowing use of simplified circuitry with minimal logic and sensor requirements.

Alternatively, markers can be configured with detection and control circuitry and logic devices such that the marker can be illuminated under low light conditions and not when the environment is well illuminated. The marker can also be configured to operate in either the continuous operation mode or the dark only mode depending on whether there is sufficient light to maintain the batteries in a good charge state.

In these designs, a processor can monitor the voltage output of the solar cell via an internal analog to digital converter in order to distinguish dark conditions from light conditions and/or can control the duration and/or frequency of light flashing.

As a further alternative, markers can be made with yet another operating mode, in which light is produced only when particularly adverse visibility conditions are present, e.g., when fog or other conditions result in substantial light reflection (e.g., when roads are wet such that extensive fine spray is created by vehicle traffic. Thus, the marker can also incorporate a reflected light sensor, e.g., a fog sensor. For example, a phototransistor can be used to monitor the amount of LED light that is reflected back to the unit. This can also be read by another channel of the internal analog to digital converter. In fog conditions or other types of wet conditions, more light will be reflected back to the case. When such conditions are detected, the processor can pulse the LEDs.

The processor can also use another analog to digital channel to detect the state of the battery.

Markers that include a reflected light sensor can be designed to operate in any of multiple modes. For example, based on input from a light condition sensor, a fog sensor, and a charge state sensor, a device can be configured to operate in any of three different modes. Mode one: with good sun the battery will be fully charged (or nearly so) so the LEDs can be flashed continuously (which can be selected to be as brightly as is possible or can be selected to be at reduced brightness). This mode can be eliminated if desired. Mode two: with moderate sun the batteries will be in good condition but often not fully charged, so the LEDs will be flashed only when it is dark. Mode three: when there is insufficient sun, so that the batteries are not getting fully charged. Under these conditions, the unit will only wake up once in a while to check if there is fog or moisture or similar conditions. If such adverse visibility conditions are present, then the LEDs will be flashed. If desired, the LED flashing can be slowed and/or the intensity reduced to reduce energy consumption in order to prolong operation. In this fashion the marker provides the maximum amount of safety that can be provided given the solar conditions. In alternate embodiments, the marker utilizes only Mode one, or Modes one and two.

The marker can be supplied ready to use. For example, when the unit is first made it can be tested fully before encapsulation. The battery can be fully charged at assembly. In order to prevent discharge, the unit can be held in an essentially inactive state until it is to be installed, or even until after it is actually installed. For example, in order to keep it fully charged during storage, it can be put into a sleep mode, e.g., by flashing a sequence of light on-light off to a detector, e.g., the photocell. The processor can be configured to recognize this as a sleep signal and put itself into a low power mode and not flash the LEDs under any conditions at all. The processor can wake up periodically, e.g., once every few seconds, to see whether there is another potential command sequence of light signals on its detector. There would then be another sequence of signals that will wake the marker circuitry up and start it running in its normal operation modes. The sequences of light would be selected to be so exclusive the odds of the unit seeing ambient light conditions as a command sequence will be virtually impossible.

Such command sequences can be provided by a control light source (e.g., a programmable light source) that will send these sequences. For example, the control light source can be designed to cover the top of the marker and deliver the light pulses to the solar cells.

Instead of light command sequences, other types of command signals can be used, for example, radio signals or magnetic signals. In another alternative, the marker goes into "sleep" mode (non-flashing) when it receives no illumination sufficient to cause a battery charging current (e.g., in particular embodiments at least 10, 20, 30, 40, 50, or more mA for a particular period of time.

It is recognized that control of marker operation can be achieved in a variety of ways. For example, control programs can be implemented in hardware, in software, or in a combination of hardware and software. All such implementations are included in the present invention. Those skilled in such implementations can perform such software programming and/or hardware implementation in conventional ways, e.g., using programming languages and coding techniques normally used for embedded processor programming.

Housing and Encapsulation

Housings for the present markers can be constructed in many different ways, but should be constructed of a material or materials resistant to a number of different environmental conditions, such as weathering, temperature variation, chemical exposure, and mechanical impact. Generally, the present markers incorporate a single piece housing. Typically a plastic material is utilized, such as a polycarbonate. For convenient construction, a polycarbonate can be selected that can be molded, e.g., by a drape method, stamp method, or vacuum forming method. One such material is sold as LEXAN® XL10 (GE Plastics). Other polycarbonates, including other LEXAN® products, can also be used, including formable products with abrasion resistant surfaces. Similar products are also available from other manufacturers.

Following assembly of marker components in the housing, the housing cavity is typically filled with a potting or encapsulation material. Generally, a material is used that is liquid, and hardens following filling of the cavity, for example, epoxy resins. Advantageously, a resin is selected that hardens sufficiently to protect the housing against breakage from impacts from motor vehicle tires and devices such as snowplows, while not being so rigid that the encapsulation material is prone to cracking.

Light Emitting Diodes

As indicated above, the road markers include low energy consumption light emitting components. Currently, LEDs are readily available and can be used for those components. Other light emitting components can be used that have similar or lesser energy consumption. Unless specific to LEDs, where LEDs are mentioned herein, such other light emitting components are intended also; in such contexts mention of LED is intended to be exemplary.

A variety of LEDs and LED configurations can be used. In some applications, LEDs are utilized that emit about 9 Candela (9000 MED) each. Each LED will typically flash (be illuminated) for only 0.5 milliseconds (ms) to a few milliseconds. In particular embodiments, each LED is illuminated for 1, 2, 3, 4, 5, 6, 7, 8, 9, 10, 11, 12, 13, 14, or 15 ms. In particular embodiments, the illumination period for each LED can be varied, e.g., between 1 and 20 ms, 2 and 20 ms, 2 and 15 ms, 2 and 12 ms, 2 and 10 ms, 4 and 20 ms. In particular embodiments, the illumination period is selectable or automatically selected based on battery charge state and/or illumination level.

In particular embodiments, different flash rates are utilized. For example, the flash rate for an individual LED can be 60–400 flashes per minute, or 70–300, 100–300, 150–300, 200–300, 200–400, 70–100, 100–120, 120–140, 140–160, 160–180, 170–190, 180–200, 200–220, 220–240, 240–260, 260–280, 280–300, 300–320, 320–340, 340–360, 360–380, or 380–400 flashes per minute. In certain embodiments, the LEDs flash approximately 3 times per second, e.g., 160–200 times per minute.

In particular embodiments, a light emitting component, e.g., LED, has a rated duty cycle of 0.5–100%, 0.5–60%, 0.5–40%, 0.5–20%, 0.5–10%, 0.5–5%. In particular embodiments, a light emitting component is used with a duty cycle of 0.5–40%, 0.5–20%, 0.5–10%, 0.5–5%, 0.5–2%, 0.2–10%, 0.2–5%, or 0.2–2%.

While markers can be constructed such that one LED is pointed in each direction in which light emission is desired (e.g., outward from each side from which light emission is desired), advantageously multiple LEDs can be directed respectively in one or more light emitting directions, e.g., 2, 3, 4, or even more. The multiple LEDs can be pointed in the same general direction, but varied slightly, thereby providing a greater visible range for approaching drivers. For example, a device can be made with 3 LEDs to flash in a single general direction. The LEDs can be slightly staggered in position so that one will point up a few degrees higher (e.g., about 6 degrees up) and one will point a few degrees lower (e.g., about 6 degrees lower) in relation to the direction of the center LED. This provides better visibility coverage under many conditions, e.g., when the marker is mounted on top of a hill or in a gully. (See, e.g., FIG. 5.)

In many applications, illumination from only one side of the marker is needed. However, in some cases, it can be desirable to have illumination from more than one side, e.g., from two opposing sides. In such cases, one or multiple LEDs can be directed to emit light through such additional side. For example, multiple LEDs with slightly varying orientation can be used to emit from the additional side.

Multiple LEDs can also be used to provide greater lateral visibility by similarly varying the angle of individual LEDs laterally (which can be separate or in combination with vertically varied LEDs). (See, e.g., Fin. 1.)

While LEDs can be mounted in various ways, in certain of the present markers, the LEDs will stick out of the sides of a circuit board. They can be held by separate pieces, e.g., separate molded polycarbonate pieces.

LEDs can also be selected that are colored (i.e., not white or warm white). Such colored LEDs can be used for special applications, e.g., to indicate a wrong direction for vehicle travel (e.g., using red), or to mark particular locations (e.g., the location of a fire hydrant). Colored filters can also be used for these purposes, but with resulting loss in light intensity.

Batteries, Solar Cells, Control Circuitry, and Sensors

Supply of electrical power to operate the light emitting components is provided by internal storage components, such as rechargeable batteries.

In order to provide long operating life, batteries are incorporated that can be trickle charged with significant deterioration in capacity or current stability. Certain Nickel Metal Hydride (NMH) batteries provide such characteristics. A particular type of suitable battery is the Panasonic H series batteries, e.g., A format.

A large variety of different charge control circuits can be utilized, e.g., circuits are described in patents cited in the Background. However, detection of the need to recharge and detection of when the battery is charged can both be done by simple voltage measurements.

An exemplary embodiment illustrated in FIGS. 1–4 incorporates 3 solar cells, e.g., producing about 1.5 volts under useful sun conditions, and a single 1.25–1.6 volt battery, for example a 1.2 V battery, e.g., a Panasonic H series battery. Particular embodiments use a 2000 ma hour version. Because of the characteristics of this type of battery, the charging circuit can be a simple diode so that the battery can be solar charged even when it is completely depleted and unable to power any of the control circuitry.

Exemplary processors that can be used include a Microchip PIC 'nanowatt' device, such as a PIC16F818 or PIC16F819 (differ only in the amount of internal memory). The processor is connected to directly flash up to 6 LEDs using its output pins. The LEDs can be flashed one at a time so that only a single current limit circuit will be used to set brightness of the LEDs. The current limit device can be a circuit or a simple resistor.

In order to reduce energy consumption while maintaining a sufficient apparent light intensity, additional energy conservation methods known in the art can be used, for example, the method described in WO 01/58219 (PCT Application PCT/IL01/00083). This reference is incorporated herein in its entirety.

Marker Placement

Road markers can be placed using a variety of different methods and materials as described in the literature, e.g., patents listed in the Background. Typically, the marker will be placed on concrete or asphalt paving materials, and will be fixed with a strong adhesive, e.g., an adhesive as typically used for attaching current road markers. Preferably, however, the adhesive is free, or substantially free of fillers (e.g., solid fillers) and colorants (i.e., less than 2% by weight of such additives). For example, a clear epoxy adhesive can be used that is free or substantially free of such fillers and colorants. Thus, the performance of the adhesive can be maximized.

The marker can be placed on a flush surface, but is preferably placed in a new cut, shallow trough. (See, e.g., FIG. 5.) The new cut contributes to strong adhesion with the adhesive. Use of such a trough is advantageous as it decreases the likelihood that the marker will become detached from the surface, e.g., due to tire or snow plow contact. In particular applications, the depth of the trough is from 0.25 up to 1.25 the height of the marker, e.g., from 0.5 to 1.25, 0.5 to 1, 0.75 to 1.25, 0.75 to 1, 0.9 to 1.25.

It can also be helpful to enhance the adhesive bond to the bottom of the marker. This can be accomplished in various ways, e.g., by increasing the roughness of the bottom of the marker, such as by embedding a bonding material such as a clean natural or synthetic stone material (e.g., clean garnet) in the bottom surface of the encapsulating material (see, e.g., FIG. 5), by using a thin layer of a strong adhesive to attach such a bonding material, or by mechanically roughening the bottom of the marker. A bonding material can be selected of suitable size and composition to achieve a strong bond. An exemplary material is garnet (e.g., Emerald Creek), which can be near gem quality, clean subangular. A blend or mix of sizes can be beneficial, e.g., 36×16 mesh size.

Figure 3:
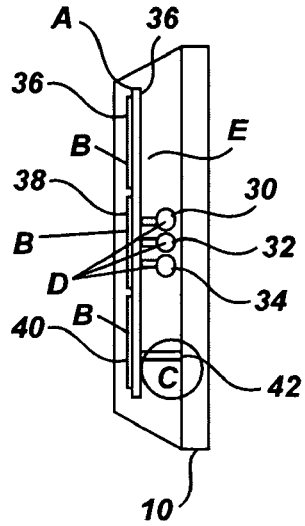
FIG. 3 is a front view of the embodiment shown in FIG. 1.
Figure 2:
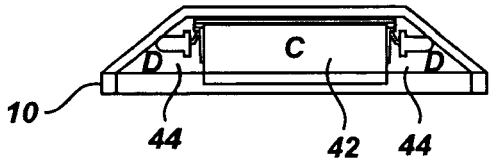
FIG. 2 is a longitudinal cross-sectional view of the embodiment shown in FIG. 1.
Figure 4:
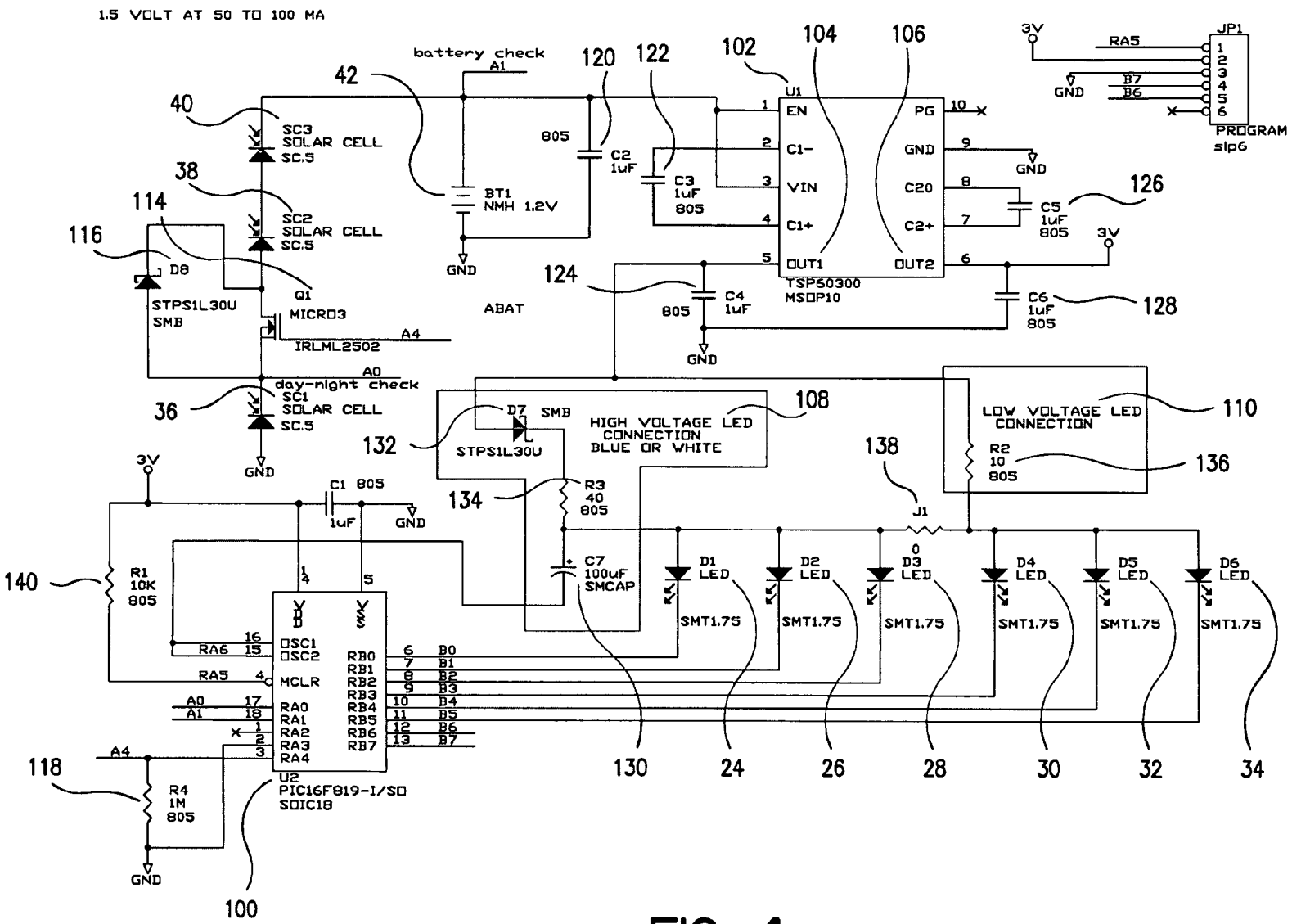
FIG. 4 is a schematic diagram of an exemplary circuit used in the embodiment shown in FIGS. 1–3.
Figure 5:
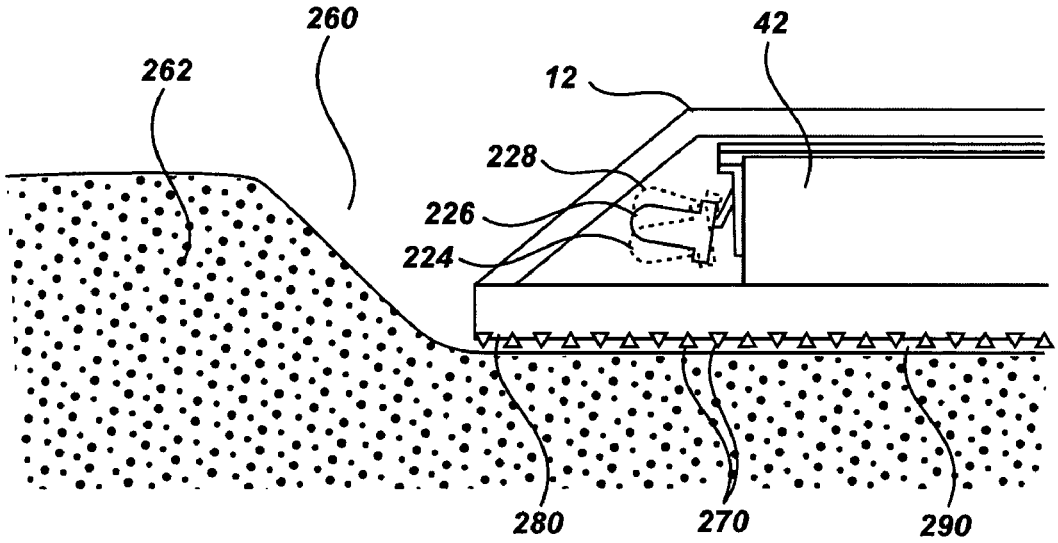
FIG. 5 diagrammatically shows a cross-sectional view of a portion of a marker similar to that shown in FIG. 1 except that it has 3 LEDs oriented in different vertical directions, in this case differing by approximately 10 degrees. Also illustrated is installation of the road marker in a shallow cut in the road surface, and the use of embedded garnet for increasing adhesion of the road marker with the adhesive.

An exemplary embodiment of the present road markers is illustrated in FIGS. 1–4. As shown in FIG. 1, road marker 10 includes a housing 12 generally in the shape of a truncated rectangular pyramid, having four inclined sides 14, 16, 18, and 20, and a top 22. Reflective tape is adhered to the inside of each of the four sides. Three LEDs, 24, 26, and 28 directed outward from side 14, directed at angles differing horizontally by about 10 degrees, and three LEDs 30, 32, and 34 directed outward from side 18 are connected to a circuit board 36 that is mounted under to top 22 of the housing 12. Mounted on the top of circuit board 36 are three solar cells, 36, 38, and 40. As shown in FIG. 2 and FIG. 3, battery 42 is positioned under circuit board 36, supplying electrical power to the electronics on the circuit board, and to the LEDs. Following placement of the internal components, the remaining space 44 (see FIG. 2) within housing 12 is filled with a potting or encapsulation material. A different LED orientation is shown in FIG. 5, where LEDs 224, 226, and 228 are oriented at angles differing vertically by about 7 degrees. In this case, the marker is installed in a shallow new cut 260 in pavement 262 using granular garnet 270 embedded in the bottom surface 280 of the encapsulating material and adhesive layer 290. For additional component identification, components A–F are:

A: Circuit Board
B: Solar Cell
C: Battery
D: LED
E: Electronics
F: Reflective Tape Exemplary circuitry for the marker is is illustrated in FIG. 4.

This exemplary design uses a tiny microcontroller (U2) 100 that runs a software program in order to run all aspects of this design. Such a program is readily coded using conventional methods. A single 1.2 volt battery (BT1) 42 runs all powered functions. A high efficient charge pump IC (UI) 102 supplies two separate voltage outputs 104 and 106 to run the processor 100 and the LED drives 108 and 110. In order to run either white or blue LEDs a voltage doubler circuit is used, as this type of LED may drop as much as 3.6 volts across it when it is on.

The exemplary design allows for up to two banks of 3 LEDs on either side. Each bank can be configured for either a high voltage LED (white or blue) or a normal LED (amber or red). All 6 LEDs can also be of the same type (either high voltage or normal), or can be a combination of both high voltage and normal.

This exemplary design is able to flash all LEDs for 24 hours a day, however if the unit is in a low charging situation (very dim light) it will drop down to flashing only when it detects a dark situation. The LEDs flash about 3 times a second, but are only on for one to a few thousands of a second to save power. If power is abundant the unit will flash the LEDs for about 10 ms (thousands of a second), however this drops down to only 1 ms (or 2 ms) if power is scarce. The LEDs are run at more than their full rated brightness which can be done because their on time compared to off time is high (they are off at least 30 times more than they are on). This low duty cycle provides low power usage.

For simpler presentation, we break the description of this exemplary design in the following sections: Solar charging and battery section, Power supply section, and LED flashing section.

Solar Charging and Battery Section

The solar charging and battery section includes parts: solar cells SC1 to SC3 36, 38, and 40, transistor Q1 114, diode D8 116, resistor R4 118, battery (BT1) 42, and connections to the microprocessor 100. The solar cells each make 0.5 volts in sun, and make up to 450 ma (thousands of an amp). Three solar cells in series charge the battery when the sun is bright enough. There are three different paths for this charging to happen. The microcontroller 100 checks the voltages at the connections to its pins A0 and A1. The voltage at A0 is dependent on the amount of power being made by SC1, and is used to tell if it is dark or light out, as well as to gauge the amount of available power. A0 and A2 connect to an internal A to D converter in the microcontroller. A1 is used to measure the voltage on the battery.

In a normal mode the battery is charged and is above 1.3 volts. The processor opens the transistor Q1 114 by putting a logic low on it's gate and disconnects the solar cells from the battery 42. Then it measures the voltage at A1. If A1 is above 1.3 volts the transistor Q1 114 will be left off in order not to overcharge the battery. There is still a potential charge path through diode D8 116, however with the battery 42 at 1.3 volts the voltage at the anode of D8 116 will be between 1.3 volts and 0.2 volts depending on the current being made by solar cells SC2 38 and SC3 40. The voltage at the cathode will be between ground and 0.5 volts, so this diode will never be forward biased. When Q1 114 is off D8 116 prevents the battery from discharging through the load of the solar cells. The approach using the mosfet Q11 14 allows this unit to run with greater efficiency and control than if just a diode were used. This is because while even a good diode drops 0.3 volts, this mosfet when it is on will drop only about 0.05 volts, therefore saving power. This mosfet approach also allows the use of 3 solar cells rather than 4.

In a mode where the battery power is too low to run the processor, Q1 114 is turned off by resistor R4 118. This will happen when the battery 42 is down below 0.9 volts. Under these conditions D8 116 will go into conduction and begin to charge up the battery. With enough light to charge and the battery at 0.9 volts, the voltage at anode of D8 116 could go as low as −0.1 volt, since the cathode would be at 0.5 volt it will go into conduction (this diode is rated for only 0.3 volts drop at 1 amp). This will allow charging to happen, and when the battery 42 is restored to above 0.9 volt the charge pump (U1) 102 will run and the processor will start.

Power Supply Section

This consists of U1 102, C2 120, C3 122, C4 124, C5 126, C6 128 and C7 130. U1 102 is a super efficient charge pump based power converter. It takes the battery input voltage and makes a doubled voltage output at OUT1 (up to 40 ma), and a regulated 3 volt output at out 2. The 3 volt supply is used to run the microprocessor. The regulated nature of this allows it to be used as an absolute voltage reference for the A to D conversion. The doubled voltage is used as the supply for the LED flashing circuit. The lower voltage was used for this because it saves power over using the 3 volt section. If we were using the 3 volt supply we would be wasting more power because it is too high a voltage for the normal (2 volt) LEDs, while not being enough for the white and blue (3.6 volt) LEDs.

LED Flashing Section

This section consists of D7 132, R3 134, C7 130, R2 136, J1 138 and LEDs (D1 to D6) 24, 26, 28, 30, 32, 34. If the unit is only going to flash amber and red LEDs (normal LEDs), Components D7 132, R3 134 and C7 130 need not be present. J1 136 is installed to provide a positive power rail to all the LEDs. In this mode of operation, power is supplied through resistor R1 140 from the doubled battery voltage output of U1 102 (OUT1). In this mode the processor pulls down one of it's outputs on B0 to B6 in order to light the LEDs one at a time.

Jumper J1 138 is a 0 ohm resistor, and it is installed whenever all the LEDs are of either of the two types, normal or high voltage. In the event that different types of LEDs are going to be used, J1 is not installed, so that the high voltage positive supply can be sent to LEDs D1 through D3, while normal positive LED power is sent to D4 to D6. In this application all parts are present except for J1.

The high voltage LED supply (for white and blue) uses D7 132, R3 134 and C7 130 in conjunction with the processor outputs from RA6 and RA7 to make a high enough voltage to forward bias these LEDs (require up to 3.6 volts). In this case the output from OUT1 is passed through D7 132, through R3 134 on to C7 130. C7 130 is charged by having pins B0 to B5 at 3 volts, reverse biasing the LEDs, while having outputs RA6 and RA7 are held at logic low. When the cap is charged there will be at least 1.5 volts on the +side with respect to the −side. To light an LED, RA6 and RA7 are brought up to 3 volts while one of the outputs (B0 to B5) are brought low. The +end of C7 130 will try to go up to at least 4.5 volts but will be discharged when it hits the voltage where the diode will go into conduction.

The exemplary design described above, is intended to be illustrative, and should not be regarded as limiting the scope of the invention. Those skilled in the art will be able to select alternate components and circuitry to provide a long-life, low power consumption road marker within the present invention.

All patents and other references cited in the specification are indicative of the level of skill of those skilled in the art to which the invention pertains, and are incorporated by reference in their entireties, including any tables and figures, to the same extent as if each reference had been incorporated by reference in its entirety individually.

One skilled in the art would readily appreciate that the present invention is well adapted to obtain the ends and advantages mentioned, as well as those inherent therein. The methods, variances, and compositions described herein as presently representative of preferred embodiments are exemplary and are not intended as limitations on the scope of the invention. Changes therein and other uses will occur to those skilled in the art, which are encompassed within the spirit of the invention, are defined by the scope of the claims.

It will be readily apparent to one skilled in the art that varying substitutions and modifications may be made to the invention disclosed herein without departing from the scope and spirit of the invention. For example, variations can be made to the particular materials and components. Thus, such additional embodiments are within the scope of the present invention and the following claims.

The invention illustratively described herein suitably may be practiced in the absence of any element or elements, limitation or limitations which is not specifically disclosed herein. Thus, for example, in each instance herein any of the terms "comprising", "consisting essentially of" and "consisting of" may be replaced with either of the other two terms. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In addition, where features or aspects of the invention are described in terms of Markush groups or other grouping of alternatives, those skilled in the art will recognize that the invention is also thereby described in terms of any individual member or subgroup of members of the Markush group or other group. Each such individual member or subgroup is specifically included in the present description.

Also, unless indicated to the contrary, where various numerical values are provided for embodiments, additional embodiments are described by taking any 2 different values as endpoints of a range. Such ranges are also within the scope of the described invention.

Thus, additional embodiments are within the scope of the invention and within the following claims.

What is claimed is:

1. An illuminated road marker, comprising a one piece housing formed of plastic, comprising a top plate and perimeter sides, wherein at least one perimeter side comprises a light transmission surface through which light can be transmitted, and wherein said top plate and said sides define a cavity in said housing;

a plurality of light emitting diodes (LEDs) positioned within said cavity and oriented at angles different by 2 to 15 degrees such that light produced by said LEDs is transmitted through the same light transmitting surface, wherein the orientation of said LEDs at different angles increases the visibility of said marker;

a long life battery within said cavity that energizes said LEDs, wherein said battery tolerates trickle charging without deterioration;

at least one solar cell within said cavity adjacent said top plate, wherein said solar cell recharges said battery and to seperately control each of said plurality of LED's; and electrical circuitry within said cavity configured to control charging of said battery.

2. The road marker of claim 1, wherein said electrical circuitry charges said battery with intermittent charging.

3. The road marker of claim 1, wherein said battery is a Panasonic Series H nickel metal hydride battery or a battery substantially equivalent thereto.

4. The road marker of claim 1, wherein said road marker is turned on by exposure to illumination.

5. The road marker of claim 1, wherein said road marker is turned on by a set of light pulses.

6. The road marker of claim 1, further comprising a reflective material disposed such that incident light from a motor vehicle approaching said marker from the light transmission side is reflected from said light transmission side, wherein said reflective material is further disposed to reflect light from said LED that is not initially transmitted through said light transmitting surface.

7. The road marker of claim 1, wherein light from a said LED is colored.

8. The road marker of claim 1, wherein said directions differ by 4 to 10 degrees.

9. The road marker of claim 1, wherein said marker operates in any of a plurality of modes comprising continuous and lightldark controlled modes.

10. The road marker of claim 1, wherein said electrical circuitry comprises a microprocessor configured to separately control said plurality of LEDs.

11. The road marker of claim 10, wherein said plurality of LEDs is 3–6 LEDs.

12. The road marker of claim 1, wherein said plurality of directions is 3 directions.

13. The road marker of claim 1, wherein said different directions comprise different vertical directions.

14. The road marker of claim 1, wherein said different directions comprises different horizontal directions.

15. The marker of claim 1, comprising a plurality of LEDs having different voltage requirements.

16. The road marker of claim 1, wherein said marker is attached to a road surface using an adhesive substantially free of fillers.

17. The road marker of claim 1, wherein said marker is attached to a road surface in a shallow new cut trough.

18. The road marker of claim 1, further comprising an encapsulating material in said cavity and a bonding material embedded in the bottom surface of said encapsulating material.

19. The road marker of claim 18, wherein said bonding material is garnet of 16–36 grit.

20. An illuminated road marker comprising a one piece housing formed of a plastic, comprising a top plate and perimeter sides, wherein at least one perimeter side comprises a light transmission surface through which light can be transmitted, and wherein said top plate and said sides define a cavity in said housing;

a plurality of up to six light emitting diodes (LEDs) positioned within said cavity such that light produced by said LEDs is transmitted through said light transmitting surface, wherein said LEDs include LEDs having different voltage requirements;

a long life battery within said cavity that energizes said LEDs, wherein said battery tolerates trickle charging without deterioration;

at least one solar cell within said cavity adjacent said top plate, wherein said solar cell recharges said battery; and electrical circuitry comprising a microprocessor within said cavity, wherein said electrical circuitry is configured to provide different voltages to said LEDs having different voltage requirements, and wherein said microprocessor directly flashes each of said plurality of LEDs.

* * * * *